US011825973B2

(12) United States Patent
Nekhala

(10) Patent No.: US 11,825,973 B2
(45) Date of Patent: Nov. 28, 2023

(54) SHEET SECURING DEVICES AND METHODS OF USE

(71) Applicant: Jack Nekhala, Linden, NJ (US)

(72) Inventor: Jack Nekhala, Linden, NJ (US)

( * ) Notice: Subject to any disclaimer, the term of this patent is extended or adjusted under 35 U.S.C. 154(b) by 114 days.

(21) Appl. No.: 17/590,992

(22) Filed: Feb. 2, 2022

(65) Prior Publication Data

US 2023/0240456 A1 Aug. 3, 2023

(51) Int. Cl.
*A47G 9/02* (2006.01)
*A47G 9/00* (2006.01)

(52) U.S. Cl.
CPC ..... *A47G 9/0246* (2013.01); *A47G 9/0238* (2013.01); *A47G 9/00* (2013.01); *A47G 9/02* (2013.01)

(58) Field of Classification Search
CPC ..... A47G 9/0246; A47G 9/0238; A47G 9/02; A47G 9/00
USPC ..... 5/495–497, 482
See application file for complete search history.

(56) References Cited

U.S. PATENT DOCUMENTS 6,189,166 B1 * 2/2001 Braine ..... A47G 11/002 5/655
7,810,184 B2 * 10/2010 McCollum ..... A47G 9/0238 5/500
8,365,361 B1 * 2/2013 Ahern ..... A47C 21/02 24/72.5
10,383,454 B2 * 8/2019 Romero ..... A47C 27/15
11,078,621 B2 * 8/2021 Bray ..... D06F 59/08
11,280,046 B1 * 3/2022 Braden ..... D06F 59/02
11,608,585 B2 * 3/2023 Bray ..... D06F 95/008
11,649,584 B2 * 5/2023 Bray ..... D06F 59/08 34/269
2006/0123544 A1 * 6/2006 Chang ..... A47G 9/0207 5/482
2006/0236455 A1 * 10/2006 Chang ..... A47G 9/10 5/482
2010/0043145 A1 * 2/2010 McCollum ..... A47G 9/0238 5/490
2010/0205787 A1 * 8/2010 Remmert ..... D06F 95/008 24/302
2013/0263386 A1 * 10/2013 Romero ..... A47G 9/0253 5/636
2016/0367041 A1 * 12/2016 Romero ..... A47C 27/142
2020/0354882 A1 * 11/2020 Bray ..... D06F 39/00
2021/0332524 A1 * 10/2021 Bray ..... D06F 59/08
2023/0088013 A1 * 3/2023 Bray ..... D06F 59/08 34/269
2023/0100997 A1 * 3/2023 Bray ..... D06F 59/08 34/269

* cited by examiner

*Primary Examiner* — Robert G Santos
(74) *Attorney, Agent, or Firm* — SLEMAN & LUND LLP

(57) ABSTRACT

In some examples, a method of cleaning a fitted sheet having four corners and an interior pocket, includes holding a fitted sheet from a center and allowing the four corners to dangle from the center so that the fitted sheet extends between a closed end at the center and an open end adjacent the four corners, coupling a securing device to the fitted sheet adjacent the open end to eliminate access to at least a portion of the interior pocket, placing the fitted sheet and the securing device in at least one of a washer and a dryer, removing the fitted sheet from the at least one of the washer and the dryer, and decoupling the securing device from the fitted sheet.

20 Claims, 5 Drawing Sheets

SHEET SECURING DEVICES AND METHODS OF USE

FIELD OF THE DISCLOSURE

The present disclosure relates generally to coverings for objects and more specifically, to device and methods for securing sheets during cleaning.

BACKGROUND OF THE DISCLOSURE

There are generally speaking, two different types of bed sheets commonly purveyed in the market. There are "fitted sheets," which have a built in elastic or other structure to hold a sheet to a bed, and there are "unfitted sheets," which comprise a layer of fabric to be tucked under the corners of a mattress, or the like. Fitted sheets typically follow the contours of a specific bed more than do unfitted sheets. The former is designed to contract around the contours of a mattress, while the latter is typically tucked under the mattress as tightly as possible. In both cases, one usually lifts at least the corners of the bed and tuck the fabric between a base of a bed and a mattress.

When fitted sheets are removed for cleaning, they are typically placed in a washer with other clothes and linens, and then removed and placed in a dryer. In some cases, the elastic of the fitted sheet creates a large pocket approximately the same size as a mattress that swallows the other clothes and linens. This may occur in the washer, the dryer or both. These other items may be improperly washed and/or dried when they are within the pocket of the fitted sheet. Additionally, the user must separate these items (and often re-dry them) after the drying cycle is complete.

SUMMARY OF THE DISCLOSURE

In some embodiments, a method of cleaning a fitted sheet having four corners and an interior pocket, includes holding a fitted sheet from a center and allowing the four corners to dangle from the center so that the fitted sheet extends between a closed end at the center and an open end adjacent the four corners, coupling a securing device to the fitted sheet adjacent the open end to eliminate access to at least a portion of the interior pocket, placing the fitted sheet and the securing device in at least one of a washer and a dryer, removing the fitted sheet from the at least one of the washer and the dryer, and decoupling the securing device from the fitted sheet.

BRIEF DESCRIPTION OF THE DISCLOSURE

Various embodiments of the presently disclosed structures and methods are described herein with reference to the drawings, wherein.

Various embodiments of the present invention will now be described with reference to the appended drawings. It is to be appreciated that these drawings depict only some embodiments of the invention and are therefore not to be considered limiting of its scope.

DETAILED DESCRIPTION

Despite the various improvements that have been made to bedding materials and devices, conventional devices and methods suffer from certain shortcomings as described above.

There therefore is a need for further improvements to the devices, systems, and methods of securing bedsheets while washing them. Among other advantages, the present disclosure may address one or more of these needs.

Figure 1:
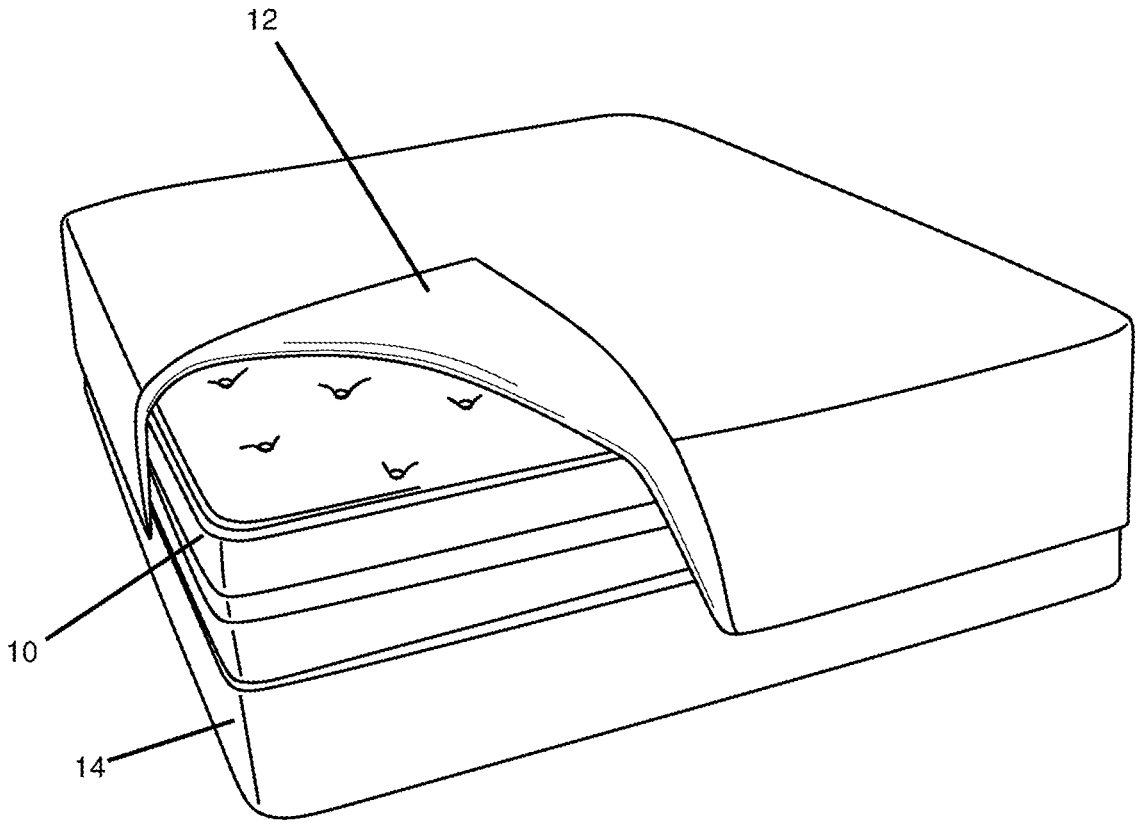
FIG. 1 shows a top perspective view of a bed with sheet, in an embodiment of the disclosure.

FIG. 1 shows a top perspective view of a bed with sheet, in an embodiment of the disclosure. Here, the mattress 10 has right, left, front, and back sides, as well as top and bottom sides. A rectangular mattress is shown, though it should be understood that a mattress of any size or shape is within the scope of the disclosure. The sheet 12 shown is an unfitted sheet draping over at least some of the sides of the mattress 10. The mattress 10 rests on a bed base 14, such as a box spring or other support for the mattress situated between the mattress and the floor.

Figure 2:
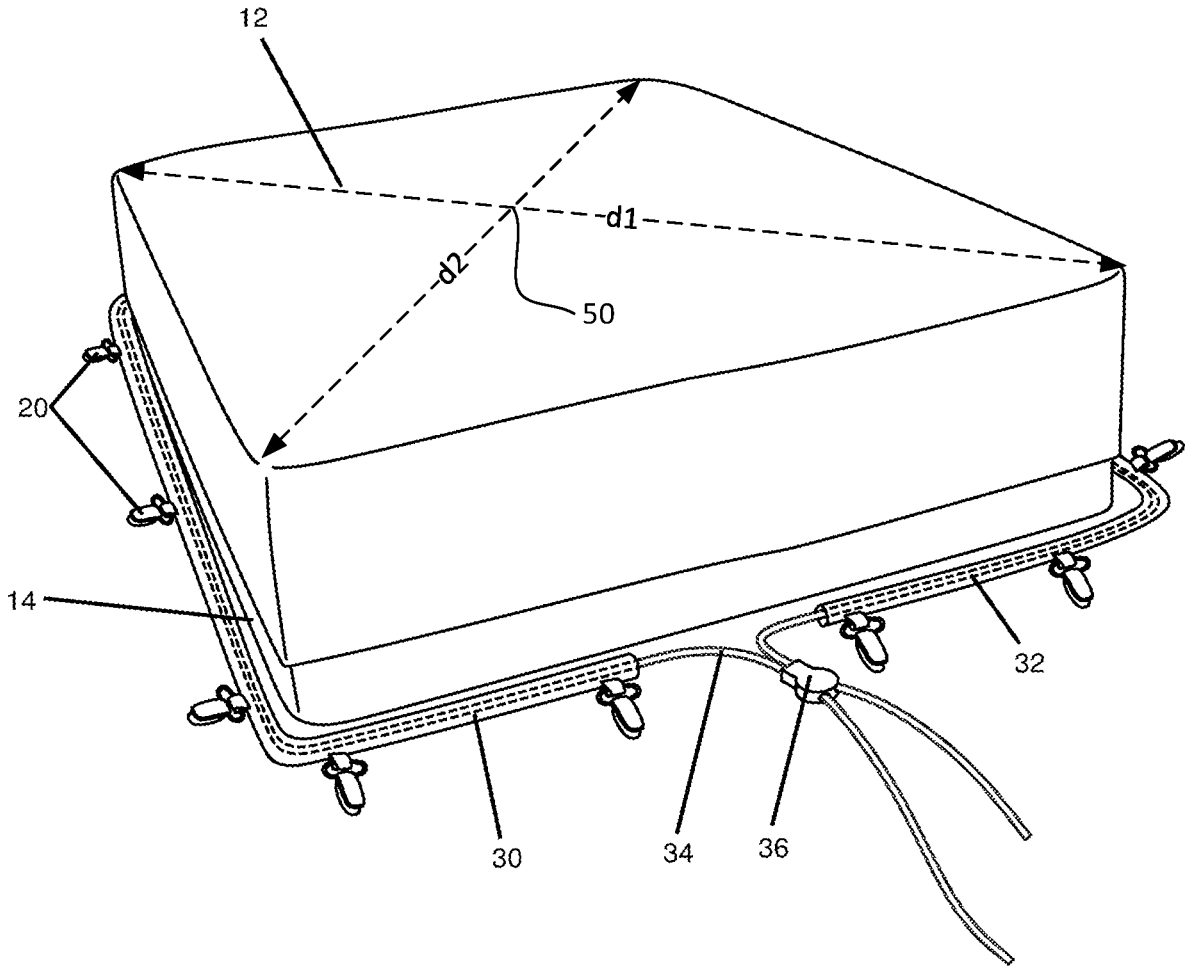
FIG. 2 shows the bed with sheet of FIG. 1, with a draw string cord placed around the perimeter of the bed.
Figure 3:
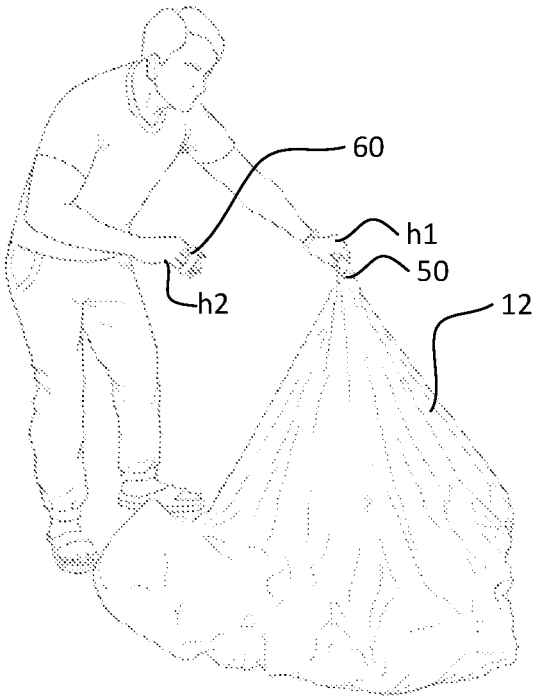
FIGS. 3-7C show a series of steps by which a user may secure a fitted sheet for washing, and a few examples of securing devices.
Figure 4:
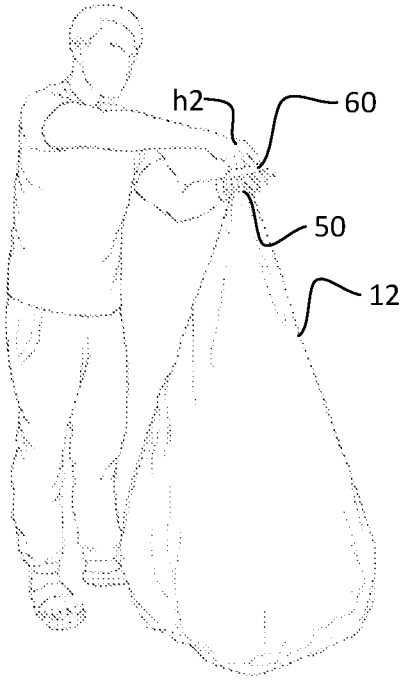

FIG. 2 shows the bed with sheet of FIG. 1, with a draw string cord placed around the perimeter of the bed. Details of the draw string cord are more fully descried in U.S. Ser. No. 16/663,276 entitled "FLEXIBLE MATERIAL TIGHTENER WITH RESILENT COUPLER," the contents of which are hereby incorporated as if full set forth herein. Briefly, the mattress is hidden from view below the sheet 12, which is shown falling on each respective side of the bed. That is, the sheet is placed primarily (mostly) over the top side, with portions hanging down over the left, right, front, and back sides of the mattress situated atop bed base 14. The draw string 34 is shown passing through the portal 32 in the cord 30. The portal runs the length of, and extends through, the cord 30. The cord 30 can be attached at a meeting point or juncture at a lock connector 36 which frictionally grasps the cord and allows one to pull the cord 30 there-through in one or both directions (decreasing or increasing the length of cord passed through the juncture 36), but in a resting position (defined as, "without human forces or human-directed forces acting thereon"), retaining a present position along the cord 30. The cord 30, the draw string 34, and/or the sheath/portal 32 can each be elastic. In this manner, the cord 30 decreases from a fully stretched out length to a lesser length from end to end while in a resting position. Thus, one stretches the cord to fit around the sides of a mattress and then decreases it in length to snugly fit and remain frictionally attached at the sides of the mattress. Clips 20 may be used to attach this system to a fitted sheet.

When a fitted sheet is ready to be cleaned, clips 20, cord 30, draw string 34 and/or connector 36 may be removed, and the sheet's built-in elastic band may be pulled off the corners of the mattress. The top of a fitted sheet is generally rectangular as shown in FIG. 2, and may be defined by two diagonals d1, d2. These two diagonals will intersect at center 50. In at least some examples, once the fitted sheet is disconnected from the flexible connector and removed at least partially from the mattress, a user may grasp the fitted sheet at, or near, center 50. Turning to FIGS. 3-6, the user may gradually lift up fitted sheet 12 via center 50 via a first hand h1 and allow the four corners of the fitted sheet 12 to fall or dangle from center 50. The user may handle a securing device 60 in a second hand h2. In the example shown, securing device 60 is in the form of an elastic band with a diameter of between approximately 1 inch and 6 inches, and the elastic band is disposed around at least some of the user's fingers of the second hand h2 (e.g., around all five fingers). The user may bring securing device 60 over center 50 (FIG. 4) and pass center 50 of fitted sheet 12 through the securing device.

Figure 5:
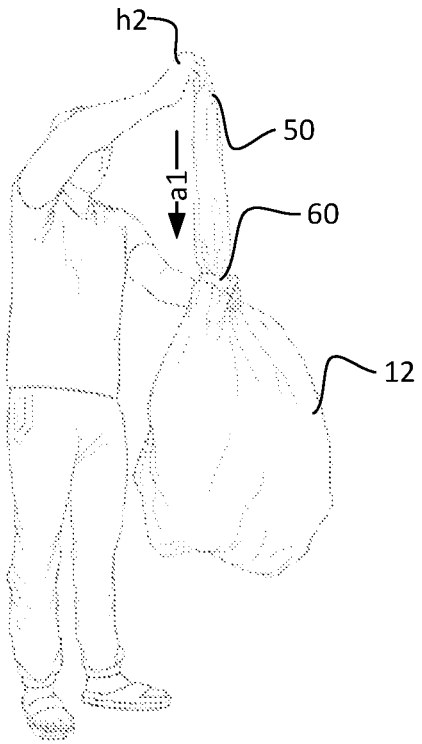
Figure 6:
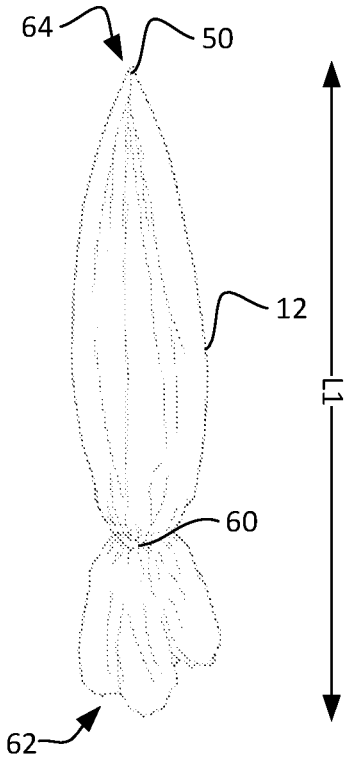

In one example, the user may grasp the fitted sheet 12 via the second hand h2, and release the sheet from the first hand h1. The free first hand h1 may then be used to slide the securing device 60 down the sheet in the direction of arrow al (FIG. 5). The securing device 60 may be brought down the fitted sheet 12 toward the lower end. In at least some examples, the securing device 60 is positioned halfway down the length Li of the gathered fitted sheet. Preferably, the securing device 60 is disposed closer to the open end 62 than the closed end 64, and more preferably, the securing device is disposed ⅔ or ⅘ along the length Li, closer to the open end 62. In one example, the length Li is approximately 5 feet, and the securing device is disposed 6" to 18" (e.g., 12") from the open end 62. With the securing device at the proper position, access to a majority of the fitted sheet pocket is unavailable. In some examples, more than 50% of the interior pocket is unavailable. In some examples, more than 70% of the interior pocket is unavailable. In some examples, more than 80% of the interior pocket is unavailable. In some examples, more than 90% of the interior pocket is unavailable. It will be understood that the portion of the interior pocket that is made inaccessible is proportional to the position of the securing device on the fitted sheet. The user may then place the fitted sheet with the securing device in the washer and/or dryer. The securing device will prevent other clothes and/or linen from being receiving within the pocket, which may allow all the items to be properly washed and/or dried.

Figure 7A:
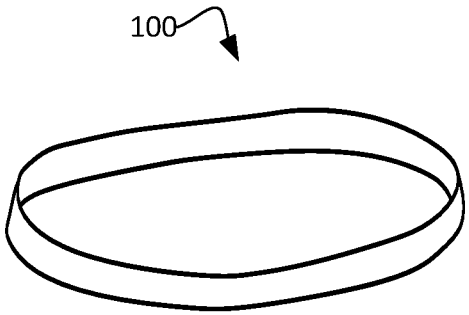
Figure 7B:
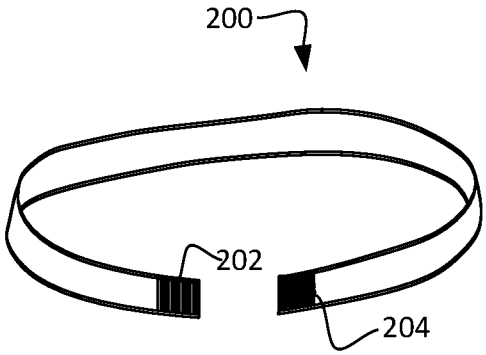
Figure 7C:
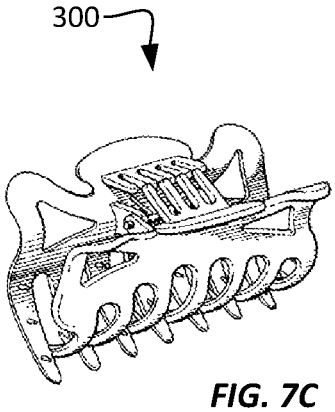

As described herein, the securing device may include an elastic band 100 with a predetermined size and elasticity as best shown in FIG. 7A. The band may be machine washable and dryable and may include materials that do not become brittle when exposed to repeated exposure to water and/or heat in cycles. Alternatively, securing device may include a flexible strip 200 with two ends having hook-and-loop segments 202,204 (e.g., VELCRO® brand of hook-and-loop), buttons or other securing features, or cords/strings that are tied together. The securing device may also comprise clips (e.g., a clip similar to a hair clip 300 best shown in FIG. 7C).

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

It will be appreciated that the various dependent claims and the features set forth therein can be combined in different ways than presented in the initial claims. It will also be appreciated that the features described in connection with individual embodiments may be shared with others of the described embodiments.

What is claimed is:

1. A method of cleaning a fitted sheet having four corners and an interior pocket, comprising:

holding a fitted sheet from a center and allowing the four corners to dangle from the center so that the fitted sheet extends between a closed end at the center and an open end adjacent the four corners;

coupling a securing device to the fitted sheet adjacent the open end to eliminate access to at least a portion of the interior pocket;

placing the fitted sheet and the securing device in at least one of a washer and a dryer;

removing the fitted sheet from the at least one of the washer and the dryer; and decoupling the securing device from the fitted sheet.

2. The method of claim 1, wherein the securing device comprises placing an elastic band about the fitted sheet.

3. The method of claim 1, wherein the securing device comprises tying a string to the fitted sheet.

4. The method of claim 1, wherein the securing device comprises coupling hook-and-loop ends of a strip about the fitted sheet.

5. The method of claim 1, wherein the securing device comprises mating two opposable jaws of a clip about the fitted sheet.

6. The method of claim 1, wherein coupling a securing device to the fitted sheet comprises passing at least a portion of the fitted sheet through the securing device.

7. The method of claim 6, wherein coupling a securing device to the fitted sheet further comprises sliding the center of the fitted sheet through the securing device.

8. The method of claim 6, wherein coupling a securing device to the fitted sheet further comprises coupling the securing device to the fitted sheet at a position closer to the open end than the closed end.

9. The method of claim 8, wherein coupling a securing device to the fitted sheet further comprises coupling the securing device at a position approximately 6 inches from the open end.

10. The method of claim 8, wherein coupling a securing device to the fitted sheet further comprises coupling the securing device at a position approximately 12 inches from the open end.

11. The method of claim 8, wherein coupling a securing device to the fitted sheet further comprises coupling the securing device at a position approximately 18 inches from the open end.

12. The method of claim 1, wherein coupling a securing device to the fitted sheet further comprises clamping the securing device to the fitted sheet.

13. A method of cleaning a fitted sheet having four corners and an interior pocket, comprising:

holding a fitted sheet from a center and allowing the four corners to dangle from the center so that the fitted sheet extends between a closed end at the center and an open end adjacent the four corners;

passing at least a portion of the fitted sheet through the securing device to eliminate access to at least a portion of the interior pocket;

placing the fitted sheet and the securing device in at least one of a washer and a dryer;

removing the fitted sheet from the at least one of the washer and the dryer; and decoupling the securing device from the fitted sheet.

14. The method of claim 13, further comprising coupling the securing device at a position approximately 6 inches from the open end.

15. The method of claim 13, further comprising coupling the securing device at a position approximately 12 inches from the open end.

16. The method of claim 13, further comprising coupling the securing device at a position approximately 18 inches from the open end.

17. The method of claim 13, wherein passing at least a portion of the fitted sheet through the securing device eliminates access to more than 50% of the interior pocket.

18. The method of claim 13, wherein passing at least a portion of the fitted sheet through the securing device eliminates access to more than 70% of the interior pocket.

19. The method of claim 13, wherein passing at least a portion of the fitted sheet through the securing device eliminates access to more than 80% of the interior pocket.

20. The method of claim 13, wherein passing at least a portion of the fitted sheet through the securing device eliminates access to more than 90% of the interior pocket.

* * * * *